US007981254B2

(12) United States Patent
Kishibe et al.

(10) Patent No.: US 7,981,254 B2
(45) Date of Patent: Jul. 19, 2011

(54) HEAT PUMP SYSTEM, OPERATION PROCEDURE THEREFOR AND EVAPORATOR SYSTEM

(75) Inventors: Tadaharu Kishibe, Hitachinaka (JP); Susumu Nakano, Hitachi (JP); Takanori Shibata, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 189 days.

(21) Appl. No.: 12/202,065

(22) Filed: Aug. 29, 2008

(65) Prior Publication Data

US 2009/0107156 A1 Apr. 30, 2009

(30) Foreign Application Priority Data

Oct. 26, 2007 (JP) ..... 2007-278285

(51) Int. Cl.
*B01D 1/28* (2006.01)
*B01D 3/00* (2006.01)
*F25B 1/00* (2006.01)

(52) U.S. Cl. ..... 202/182; 62/115; 62/324.3; 62/515; 159/24.1; 202/202; 203/10; 203/DIG. 4

(58) Field of Classification Search ..... 62/115, 62/324.3, 498, 515; 159/24.1; 202/182, 202/202; 203/10, 24, 26, DIG. 4
See application file for complete search history.

(56) References Cited

U.S. PATENT DOCUMENTS

| | | | | |
|---|---|---|---|---|
| 3,733,994 | A * | 5/1973 | Armstrong et al. | 202/152 |
| 4,342,624 | A * | 8/1982 | Chute et al. | 202/176 |
| 4,361,015 | A * | 11/1982 | Apte | 62/238.4 |
| 4,954,151 | A * | 9/1990 | Chang et al. | 62/532 |
| 5,329,758 | A * | 7/1994 | Urbach et al. | 60/775 |
| 5,507,141 | A * | 4/1996 | Stigsson | 60/775 |
| 6,846,390 | B1 * | 1/2005 | Bishkin | 203/24 |
| 7,340,879 | B2 * | 3/2008 | Kamen et al. | 60/783 |
| 2007/0089451 | A1 * | 4/2007 | Lee | 62/352 |
| 2008/0184720 | A1 * | 8/2008 | Morgan et al. | 62/150 |
| 2008/0216461 | A1 * | 9/2008 | Nakano et al. | 60/39.53 |
| 2009/0100857 | A1 * | 4/2009 | Ophir et al. | 62/347 |

* cited by examiner

*Primary Examiner* — Virginia Manoharan
(74) *Attorney, Agent, or Firm* — Mattingly & Malur, PC

(57) ABSTRACT

In a heat pump system including a water purifier and an evaporator for evaporating feed-water to produce steam, water used for spray cooling is effectively used and productivity of purified water used for the spray cooling is increased. Discharged water from the water purifier is supplied to the evaporator when water used for spray cooling is produced by use of the water purifier. Otherwise, drain of the evaporator having higher temperature is supplied to the water purifier by using such a fact that in a reverse osmosis membrane type water purifier, the higher the temperature of feed-water is, the higher the purified water productivity becomes.

1 Claim, 5 Drawing Sheets

HEAT PUMP SYSTEM, OPERATION PROCEDURE THEREFOR AND EVAPORATOR SYSTEM

BACKGROUND OF THE INVENTION

1. Field of the Invention

The present invention relates to a heat pump system, an operation procedure therefor and an evaporator system.

2. Description of the Related Art

In the field of use of a heat pump technology and of VRC (vapor re-compression) technology, wasted heat from factories, power generation equipment or the like has been recently recovered by a heat pump to achieve energy saving. In addition, VRC technology has been used in industrial drying processes to significantly reduce energy required for drying.

There are various types of heat pumps and of VRC systems. The following system is conceivable. Feed-water is changed into working steam for the system by an evaporator. Furthermore, for the sake of further achievement of energy saving by reducing compression power, water is sprayed upstream of or downstream of a compressor to cool the working steam.

Examples of water supplied to the heat pumps or to the VRC systems include tap water, industrial water, and factory-discharged heated water. It is conceivable that such feed-water is converted into purified water by using a water purifier in order to avoid erosion or contamination of compression equipment such as a centrifugal compressor included in the system or to extend the life of a water spray nozzle.

However, there is a problem as below. Although the approximate half of water supplied to the water purifier is converted into purified water, the remaining half of the water is discharged as discharged water from the water purifier.

For example, JP-A-9-248571 discloses the technology of effectively utilizing discharged water from the water purifier. Specifically, the discharged water is mixed with raw water of the water purifier and the mixed water is used as raw water.

The technology described in JP-A-9-248571 restores the discharged water of the water purifier to raw water for reuse. However, since recirculation of the discharged water causes contaminations to be concentrated in water, effective utilization efficiency is not so high.

SUMMARY OF THE INVENTION

It is an object of the present invention to effectively use water in a system including an evaporator and a water purifier.

According to an aspect of the present invention, there is provided an evaporator system including: a water purifier; an evaporator for evaporating feed-water to produce steam; and a supply system used to supply discharged water from the water purifier to the evaporator, or a supply system used to supply drain of the evaporator to the water purifier.

According to the aspect of the present invention, water can effectively be used in the system including the evaporator and the water purifier.

DESCRIPTION OF THE PREFERRED EMBODIMENTS

The best mode for carrying out the invention conceivably includes the fact that two water-use lines, respective water-use lines for an evaporator and for a water purifier, mutually use their discharged water.

For example, it is conceivable that discharged water from the water purifier is supplied to the evaporator and that evaporator drain is supplied to the water purifier. This can achieve effective utilization of water.

First Embodiment

Figure 5:
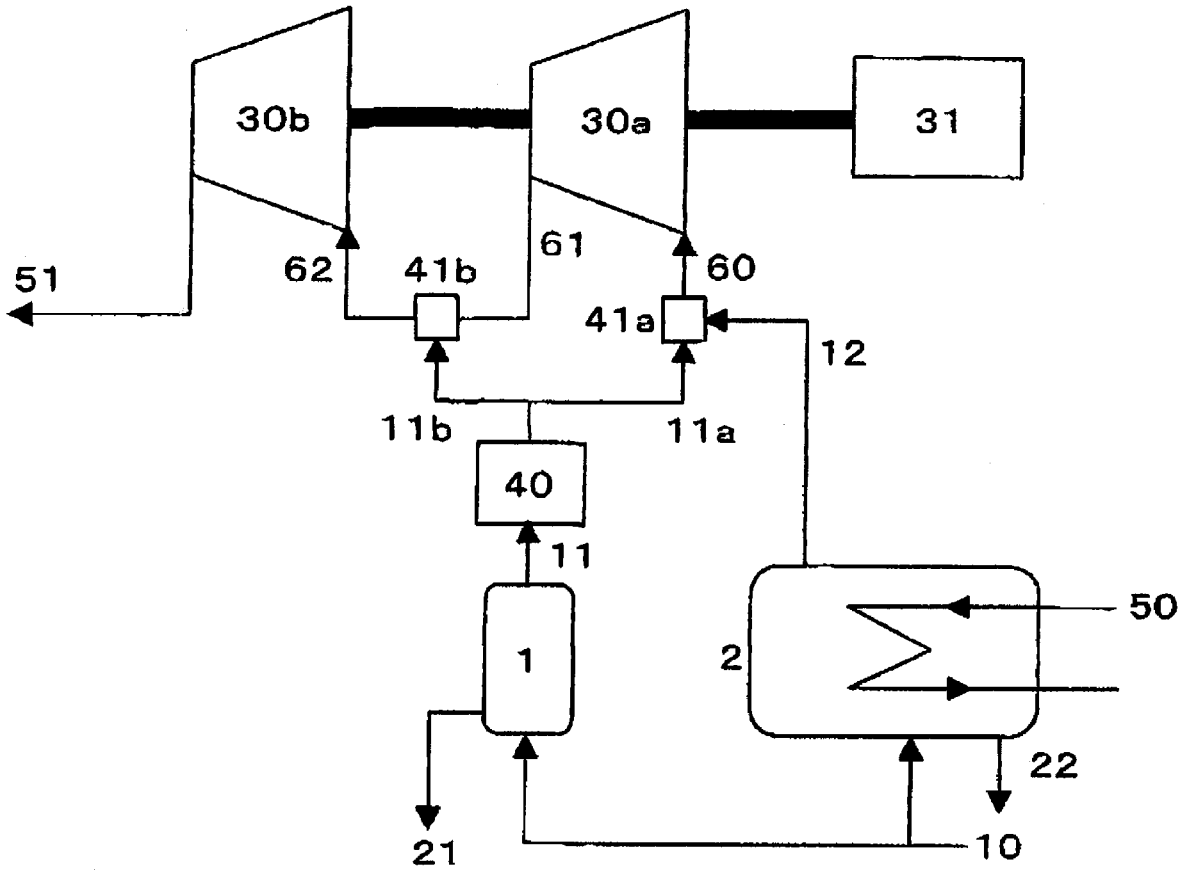
FIG. 5 is a systematic diagram of a heat pump system.

A description will hereinafter be given of a steam compressor and a heat pump system according to a first embodiment of the present invention. A description is first given of a configuration of the heat pump system using the steam compressor with reference to FIG. 5. FIG. 5 is a systematic diagram of the heat pump system. The heat pump system of FIG. 5 includes an evaporator 2 using wasted heat 50 as a heat source. In the heat pump system, steam 12 produced by the evaporator 2 is increased in temperature and in pressure by steam compressors 30*a* and 30*b*, and this high-temperature and high-pressure steam is supplied to a demander. Specifically, the heat pump system includes the evaporator 2 for generating saturated steam 12 by subjecting feed-water 10 and exhaust heat 50 as an external heat source to heat exchange; the steam compressors 30*a*, 30*b* for compressing the saturated steam 12 produced; and a drive 31 for driving the steam compressors 30*a*, 30*b*.

The steam compressors 30*a*, 30*b* of the present embodiment are composed of a two-stage compressor including a first-stage compressor 30*a* and a second-stage compressor 30*b*. However, it is not necessary that the number of stages is two as long as a steam compressor has specifications satisfying a predetermined pressure ratio. Otherwise, it is sometimes necessary to increase the number of stages in order to satisfy the predetermined pressure ratio.

The steam 12 produced by the evaporator 2 is supplied to a humidifying device 41*a*. A portion of the feed-water 10 is supplied as spray-cooling water 11*a* through the water purifier 1 to the humidifying device 41*a* by a pump 40 to subject steam 12, working fluid of the steam compressor 30*a*, to inlet air cooling. Between the first-stage compressor 30*a* and the second-stage compressor 30*b* another portion of the feed-water 10 is supplied as spray-cooling water 11*b* by the pump 40 through the water purifier 1 to a humidifying device 41*b* installed between the first-stage compressor 30*a* and the second-stage compressor 30*b*. Steam, working fluid of the compressor 30*b*, is intercooled by water-spray from the humidifying device 41*b*. Incidentally, the less compression power of a turbo-machine can achieve a high-pressure ratio as the temperature of the working medium in a compression process is lower. Accordingly, the thermal efficiency of the heat pump system can be improved by executing the inlet air cooling and intercool as described above by the respective associated humidifying devices 41 for humidifying the steam 12 which is the working fluid before introduction into the corresponding compressors.

It is the approximate half of water supplied to the water purifier that can be converted into purified water, which is used as the spray-cooling water 11. The remaining half of the water is discharged as water purifier-discharged water 21. It is desirable that trap means may be installed for removing impurities of the discharged water 21 of the water purifier 1, the discharged water 21 being supplied to the evaporator 2. Specifically, the trap means for separating and discharging impurities harmful to the steam compressor system is installed in the supplying system or evaporator 2 and the remaining half of the water is discharged to the outside through the drain 22 of the evaporator 22. Thus, any damage to the compressors can be suppressed.

A description is next given of the flow of the working fluid in the heat pump system. The feed-water 10 is supplied in a liquid state to the evaporator 2. The water 10 is heat-exchanged with wasted heat, an external heat source such as factory waste heat, in the evaporator 2 to be increased in temperature to reach saturation, and partially evaporated, i.e., becoming the steam 12. The steam 12 produced by the heat exchange is inlet air cooled by the humidifying device 41*a* and then flows as saturated steam 60 into the first-stage compressor 30*a* of the steam compressor. The saturated steam 60 is increased in temperature and in pressure by the first-stage compressor 30*a* to become high-temperature and high-pressure superheated steam 61. The superheated steam 61 is humidified and cooled by the humidifying device 41*b* installed between the first-stage compressor 30*a* and the second-stage compressor 30*b* and led to the second-stage compressor 30*b*. The steam thus led is further increased in temperature and in pressure to become superheated steam 51. This superheated steam 51 is used as an industrial heat source in heat utilization facilities such as paper-manufacturing companies, food factories, local heating and cooling plants, chemical factories, etc.

Figure 1:
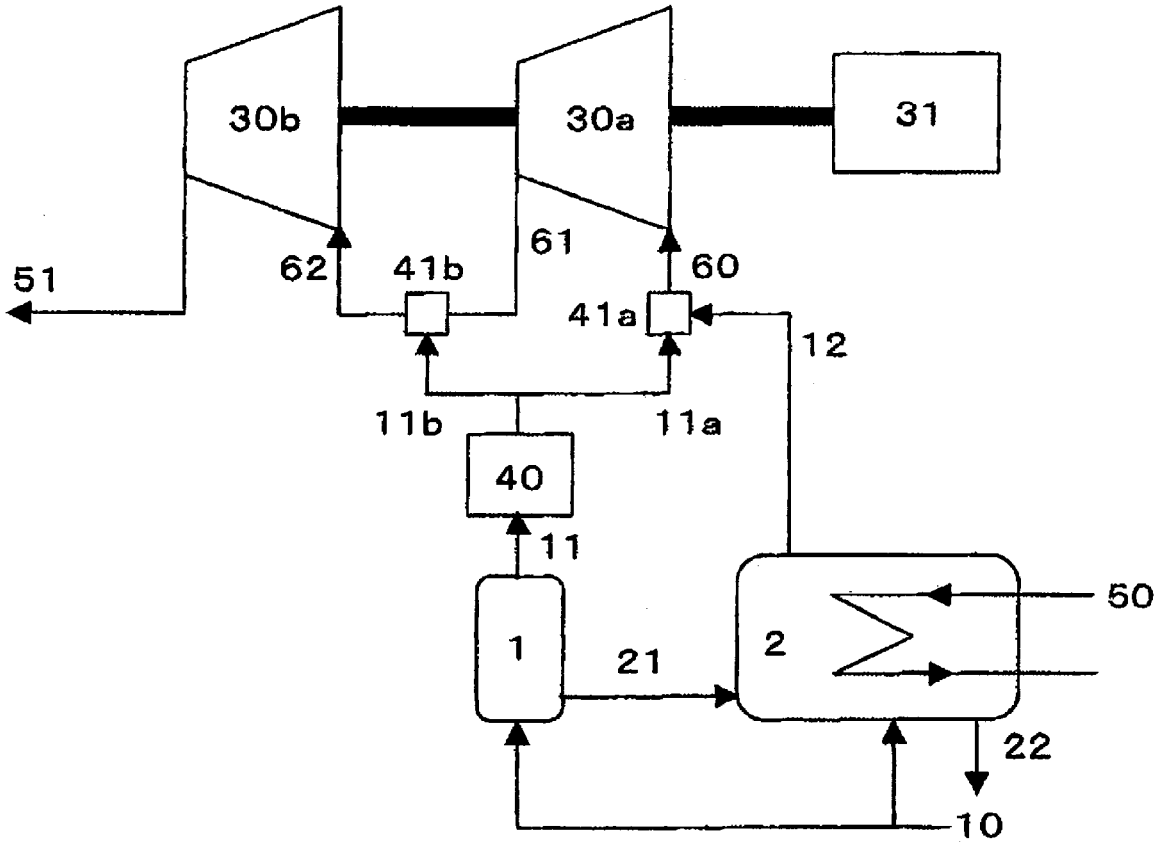
FIG. 1 is a diagram (a first embodiment) for assistance in explaining a method of executing connecting construction of piping between an evaporator and a water purifier.

A specific description is next given with reference to FIG. 1. The evaporator system mainly includes the evaporator 2 for producing steam and the water purifier 1 for making purified water. The heat pump system includes the evaporator 2 for producing steam; the compressors 30*a*, 30*b* for compressing the steam from the evaporator 1; the water purifier 1 for making purified water; the humidifying devices 41*a* and 41*b* for humidifying steam supplied to the compressors 30*a* and 30*b*, respectively, by using the purified water from the water purifier 1; and the supply system used to supply the discharged water 21 of the water purifier 1 to the evaporator 2. That is to say, the present embodiment includes, as the water utilization line, the two systems consisting of the water system of the water purifier 1 and the water system of the evaporator 2 for evaporating the feed-water to produce steam. The approximate half of the water supplied to the water purifier 1 is converted into purified water, which is used as the spray cooling water 11. The remaining half is discharged as the discharged water 21 of the water purifier.

Efficient use of water can be achieved by provision of the supply system used to supply the discharged water 21 of the water purifier 1 to the evaporator 2. In other words, the water purifier 1 is connected to the evaporator 2 through piping so as to supply the discharged water 21 of the water purifier 1 to the evaporator 2. This can reduce the amount of feed-water 10 supplied to the evaporator 2. Thus, the discharged water 21 of the water purifier can efficiently be utilized.

When heat is recovered from discharged heated water, the pressure in the evaporator 2 becomes negative pressure lower than the atmospheric pressure by about 0.02 MPa. If the discharged water 21 of the water purifier 1 is passed through a filer with large resistance, it is sometimes necessary to install a pump in piping between the water purifier 1 and the evaporator 2. If it is not necessary to pass the discharged water 21 of the water purifier 1 through a filter, the discharged water 21 flows to the evaporator 2 due to the differential pressure between the water purifier 1 and the evaporator 2.

The purified water converted partially from the water supplied to the water purifier 1 is used as the spray cooling water 11. Consequently, the discharged water 21 of the water purifier 1 contains almost all inorganic substances, organic substances, impurities, etc. that were contained in the feed-water 10. Since such discharged water 21 is supplied to the evaporator 2, the trap is installed in the evaporator 2 to separate and discharge impurities harmful to the steam compressor system. Further, the steam 12 to be generated by the evaporator 2 is produced by the water evaporated in the evaporator 2; therefore the steam 12 contains little or no harmful impurities.

In the present embodiment as described above, while the thermal efficiency of the heat pump system is increased, water used for spray cooling is produced by the water purifier and the discharged water of the water purifier is led to another system's water utilization device for effective utilization. In addition, the water purifier is installed on the spray cooling water line to extend the life of the compressor or of the water spray nozzle and to provide an effect of reducing water consumption.

Second Embodiment

Figure 2:
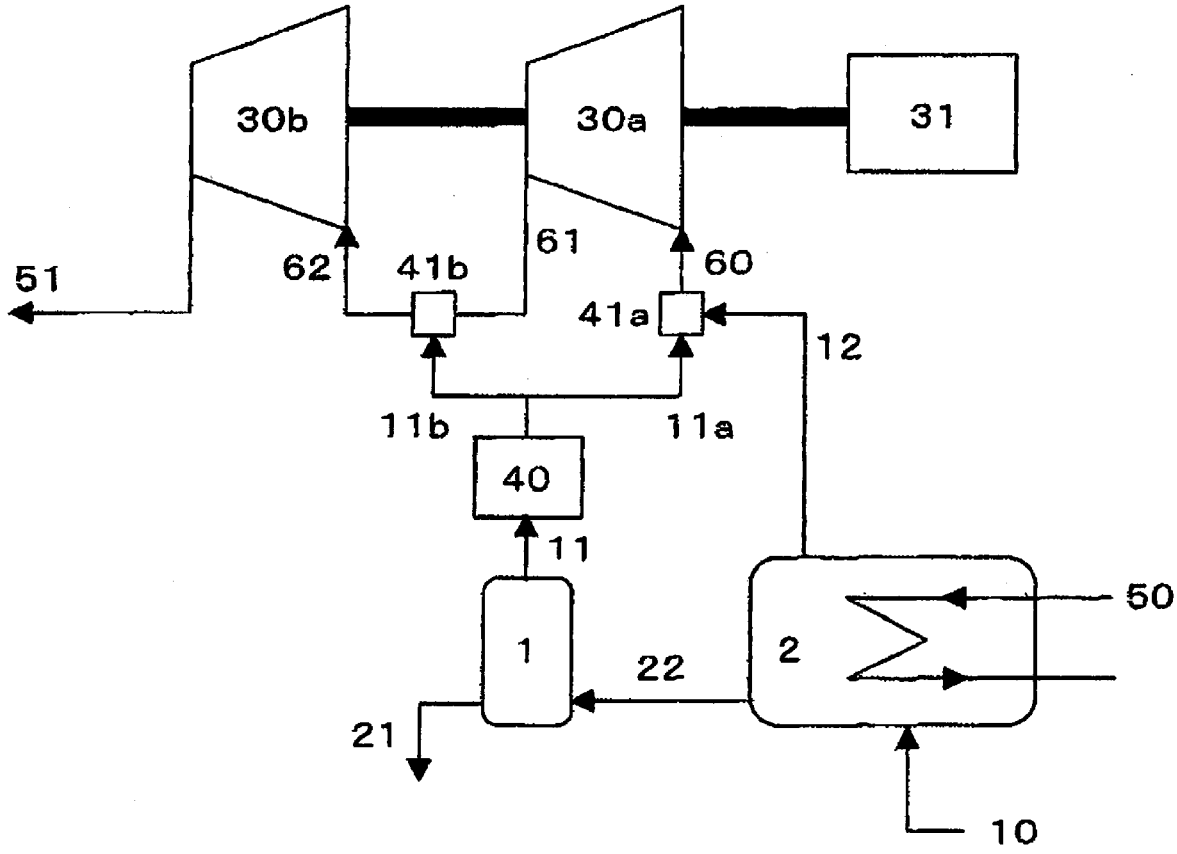
FIG. 2 is a diagram (a second embodiment) for assistance in explaining a method of executing connecting construction of piping between an evaporator and a water purifier.

A second embodiment is described with reference to FIG. 2. The second embodiment includes a supply system used to supply drain of an evaporator 2 to a water purifier 1. Specifically, the drain 22 of the evaporator 2 is supplied to the water purifier 1 to increase the productivity of purified water used for spray cooling. It is sometimes necessary to install a pump in piping between the evaporator 2 and the water purifier 1 depending on a pressure difference between the drain of the evaporator 2 and the water purifier 1.

Temperature of water supplied to the water purifier 1 can be increased by supplying the drain 22 of the evaporator 2 to the water purifier 1. For a reverse osmosis membrane type water purifier 1, the higher the temperature of water supplied is, the higher the purified water productivity of the water purifier 1. The respective water temperatures of 5° C. and 20° C. provide a difference of about 10% to 15%. As described above, an effect of recovering wasted heat of the evaporator drain 22 can be obtained. In short, the present embodiment can provide increased purified water productivity and the effect of recovering heat from the evaporator drain.

Third Embodiment

Figure 3:
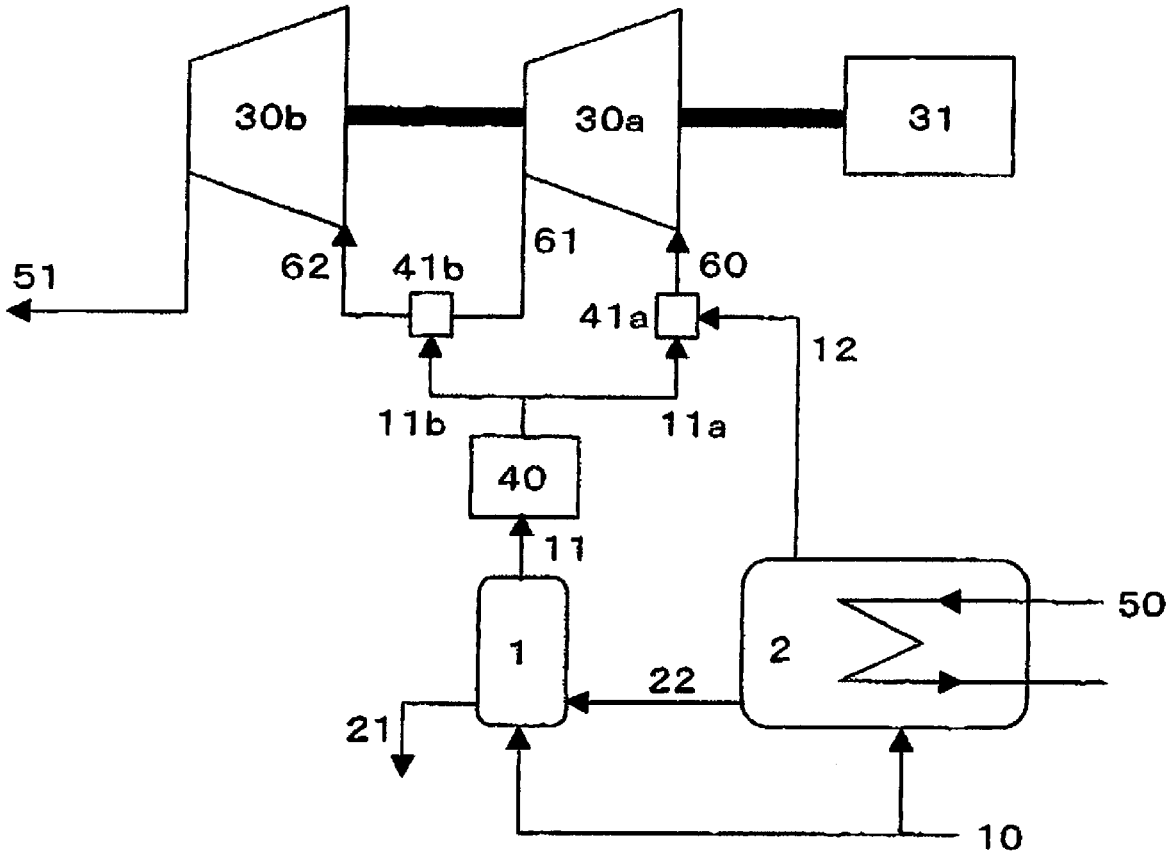
FIG. 3 is a diagram (a third embodiment) for assistance in explaining a method of executing connecting construction of piping between an evaporator and a water purifier.

A third embodiment is described with reference to FIG. 3. As with the second embodiment, in the third embodiment, an evaporator 2 is connected to a water purifier 1 through piping so as to supply drain 22 of the evaporator 2 to the water purifier 1. This can effectively utilize the drain 22 of the evaporator to increase the productivity of purified water used for spray cooling. In this case, an amount of feed-water necessary for the water purifier 1 is not filled with the evaporator drain 22 alone. Therefore, also feed-water 10 such as tap water, industrial water, factory heated wasted-heat or the like, supplied from the outside is supplied to the water purifier 1. Incidentally, as with the second embodiment, it is sometimes necessary to install a pump in piping between the evaporator 2 and the water purifier 1 depending on a pressure difference between the evaporator 2 and the water purifier 1.

Fourth Embodiment

Figure 4:
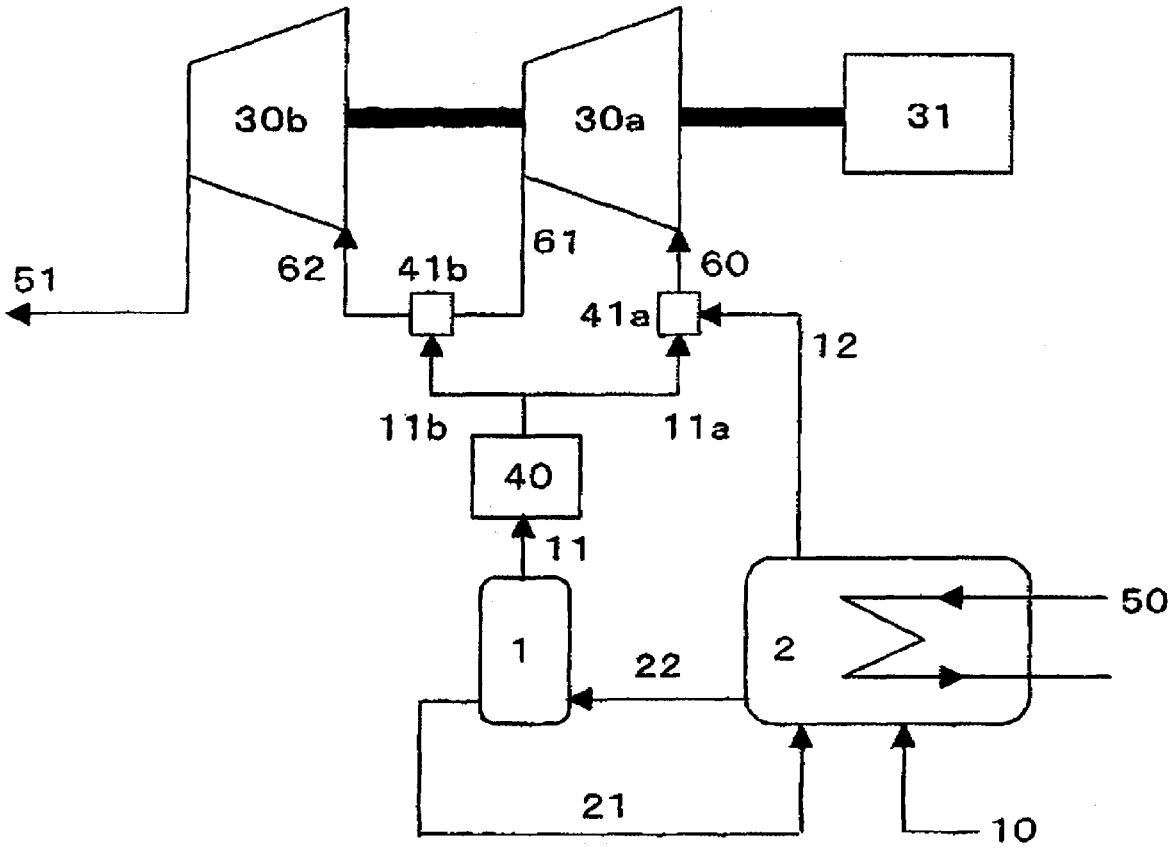
FIG. 4 is a diagram (a fourth embodiment) for assistance in explaining a method of executing connecting construction of piping between an evaporator and a water purifier.

A fourth embodiment is described with reference to FIG. 4. As with the second embodiment, in the fourth embodiment, an evaporator 2 is connected to a water purifier 1 through piping so as to supply drain 22 of the evaporator 2 to the water purifier 1. This can effectively utilize the evaporator drain 22 to increase the productivity of purified water used for spray cooling. In this case, as with the first embodiment, the water purifier 1 is connected to the evaporator 2 through piping so as to supply discharged water 21 of the water purifier 1 to the evaporator 2. This can effectively utilize the discharged water 21 of the water purifier 1.

As with the first embodiment, when the discharged water 21 of the water purifier 1 is passed through a filer with large resistance, it is sometimes necessary to install a pump in piping between the water purifier 1 and the evaporator 2. If it is not necessary to pass the discharged water 21 of the water purifier 1 through a filter, the discharged water 21 flows to the evaporator 2 due to the differential pressure between the water purifier 1 and the evaporator 2. In addition, as with the second embodiment, it is sometimes necessary to install a pump in piping between the evaporator 2 and the water purifier 1 depending on pressure difference between the drain of the evaporator 2 and the water purifier 1.

Incidentally, the purified water converted partially from the water supplied to the water purifier 1 is used as the spray cooling water 11. Therefore, the discharged water 21 of the water purifier 1 contains almost all inorganic substances, organic substances, impurities, etc. that were contained in the water supplied to the water purifier 1. Since such discharged water 21 is supplied to the evaporator 2, the trap is installed in the evaporator to separate and discharge impurities harmful to the steam compressor system. Further, the steam 12 to be produced by the evaporator 2 is produced from the water evaporated in the evaporator 2; therefore the steam 12 contains little or no harmful impurities.

What is claimed is:

1. A heat pump system comprising:

a water purifier;

an evaporator for evaporating feed-water to produce steam;

a compressor for compressing the steam produced by the evaporator, and supplying the compressed steam; and a supply system used to supply discharged water from said water purifier to said evaporator, wherein the water purifier converts a portion of raw water into purified water and discharges a remainder of the raw water as discharged water, and the heat pump system further comprising:

a humidifying device for humidifying steam supplied to the compressor by using purified water from said water purifier; and trap means for removing impurities from the discharged water from said water purifier to said evaporator.

* * * * *